US005499871A

United States Patent [19]

Ulrich et al.

[11] Patent Number: 5,499,871

[45] Date of Patent: Mar. 19, 1996

[54] DEVICE FOR PRODUCING LIQUID EMULSION OF HYDROPHOBIC AND HYDROPHILIC LIQUID

[75] Inventors: Armando Ulrich, Auw; Walter H. Ott, deceased, late of Stäfa, both of Switzerland

[73] Assignee: Tecno-Bio Co., Ltd., Tokyo, Japan

[21] Appl. No.: 926,461

[22] Filed: Aug. 7, 1992

Related U.S. Application Data

[62] Division of Ser. No. 811,251, Dec. 20, 1991, abandoned.

[30] Foreign Application Priority Data

Apr. 21, 1989 [DE] Germany ..... 8905075 U
Apr. 22, 1989 [JP] Japan ..... 1-103268

[51] Int. Cl.[6] ..... B01F 5/06

[52] U.S. Cl. ..... 366/136; 366/336; 366/338; 366/165.1; 138/42; 138/44

[58] Field of Search ..... 366/136, 137, 366/159, 165, 167, 336, 338, 340; 138/42, 44; 123/25 E

[56] References Cited

U.S. PATENT DOCUMENTS

| | | | |
|---|---|---|---|
| 1,637,697 | 8/1927 | Jacobsen | 366/336 |
| 2,187,010 | 1/1940 | Beckman | 138/44 |
| 2,202,649 | 5/1940 | Dodge | 138/42 |
| 2,740,616 | 4/1956 | Walden | 366/336 |
| 2,877,929 | 3/1959 | Ireland | 366/136 |
| 3,198,142 | 8/1965 | Lothes | 366/136 |
| 3,207,484 | 9/1965 | Rubin | 366/336 |
| 4,266,879 | 5/1981 | McFall | 366/336 |
| 4,718,462 | 1/1988 | Fix | 366/136 |
| 4,938,606 | 7/1990 | Kunz | 366/136 |
| 4,955,723 | 9/1990 | Schneider | 366/136 |

FOREIGN PATENT DOCUMENTS

| | | | |
|---|---|---|---|
| 0291820 | 11/1988 | European Pat. Off. | 366/136 |
| 0312642 | 4/1989 | European Pat. Off. . | |
| 0051159 | 4/1977 | Japan | 366/336 |

OTHER PUBLICATIONS

M. Schwartz, James W. Perry. "Surface Active Agents. Inostrannaya Literature, Moscow, 1953, pp. 338–339, Surface Active Agents, Their Chemistry and Technology by the same authors, New York–London, 1949".

*Primary Examiner*—David A. Scherbel
*Assistant Examiner*—Randall E. Chin
*Attorney, Agent, or Firm*—Michael N. Meller

[57] ABSTRACT

A device for producing a liquid emulsion of a hydrophobic and hydrophilic liquid is described. The emulsion consists of at least one hydrophobic liquid phase and at least one hydrophilic liquid phase, one of said phases being a disperse phase of the emulsion, which has a stable colloidal state with a particle size of the disperse phase of 1,000 nm or less, preferably a particle size in the range of 100 to 500 nm. The device includes a mixing apparatus (1) comprising a mixing chamber of a rotational symmetrical shape in a hollow element (14) with a plurality of tangential inlet openings (15) opening into a first chamber portion connected to a second chamber portion having a tapering section in flow direction and an axial outlet being coaxial with the axis of the mixing chamber, the first chamber portion has a rotational paraboloid form and second chamber portion has a rotational inverse hyperboloid form, said axial outlet being a cylindrical duct portion (18), the parabolic wall (14) of said first chmber portion defining a focal line falling in the axis of rotation, said inlet openings (15) being arranged at a wide cross-section of the first chamber portion which is connected to the second chamber portion at the widest cross-section thereof, and the sum of the cross-sections of the inlet openings (15) substantially corresponds to the cross-section of said duct portion (18).

3 Claims, 7 Drawing Sheets

DEVICE FOR PRODUCING LIQUID EMULSION OF HYDROPHOBIC AND HYDROPHILIC LIQUID

This is a division of application Ser. No. 811,251, filed Dec. 20, 1991, now abandoned.

The present invention relates to a preparation method and device for stably mixing a plurality of substances differing in their physical properties, especially a liquid and a liquid, and a mixture emulsion formed thereby.

Various proposals have heretofore been made on the method and apparatus for mixing a plurality of substances differing in their physical properties. For example, many methods have been proposed as the means for obtaining mixtures of a hydrophobic liquid and water. However, according to these methods, stable liquid mixtures of water and a hydrophobic liquid are obtained by using an emulsifier.

Use of an emulsifier results in an increase of the cost and when the water/hydrophobic liquid is used, for example, for cosmetics or the like, several limitations are imposed in view of influences on the human body.

It is known that various gases can be dissolved in various liquids and an optional specific gas is always present in a unit volume of water in a defined maximum amount, that is, a saturation amount, under optional predetermined temperature and pressure conditions. In connection with oxygen, saturation amounts in octane which is a hydrophobic liquid and methyl alcohol which is a hydrophilic liquid are shown on page 164 of Basic Volume 2 of "Handbook of Chemistry" (revised 3rd edition, Jun. 25, 1984) published by Maruzen-Sha.

It is a primary object of the present invention to provide a mixing method for stably mixing substances differing in the physical properties, i.e. a hydrophobic liquid and a hydrophilic liquid.

Another object of the present invention is to provide a mixing device for use in carrying out this mixing method.

Still another object of the present invention is to provide a stable mixture emulsion of at least one hydrophobic liquid phase and at least one hydrophilic liquid phase and prepared or preparable by this mixing apparatus.

The emulgator-free emulsion, the method and the mixing device in accordance with the present invention have especially the features as described in the claims.

In accordance with the present invention, there is provided a colloidal emulgator-free emulsion comprising a hydrophilic liquid, especially water, and a hydrophobic liquid, wherein fine liquid drops of the disperse liquid phase are homogeneously and stably distributed in the emulsion without the aid of an emulsifier. In the present invention, the preferred composition of the water/hydrophobic liquid mixture is such that the amount of the hydrophobic liquid is up to 20% by volume based on water.

Furthermore, in accordance with the present invention, there is provided a mixture comprising water and a hydrophobic liquid, wherein fine liquid drops of the water are homogeneously and stably distributed in the hydrophobic liquid without the aid of an emulsifier. In the present invention, the preferred composition of the water/hydrophobic liquid mixture is such that the amount of the water is 5–35% by volume based on the hydrophobic liquid.

Moreover, in accordance with the present invention, there is provided a colloidal mixture comprising a hydrophilic liquid and a hydrophobic liquid, wherein fine liquid drops are homogeneously and stably distributed without the aid of an emulsifier. In the present invention, the preferred composition of the hydrophilic liquid and the hydrophobic liquid is such that the amount of the hydrophobic liquid is up to 20% by volume based on the hydrophilic liquid.

The term "colloid" or "colloidal" state means a state in which colloidal particles having a size of about 1,000 nm or less are contained, the existence of the colloidal particles and the occurrence of a Brownian movement are confirmed by an ultramicroscope, and a Tyndall phenomenon is observed.

The present invention will now be described in detail with reference to preferred embodiments illustrated in the accompanying drawings.

Figure 1:
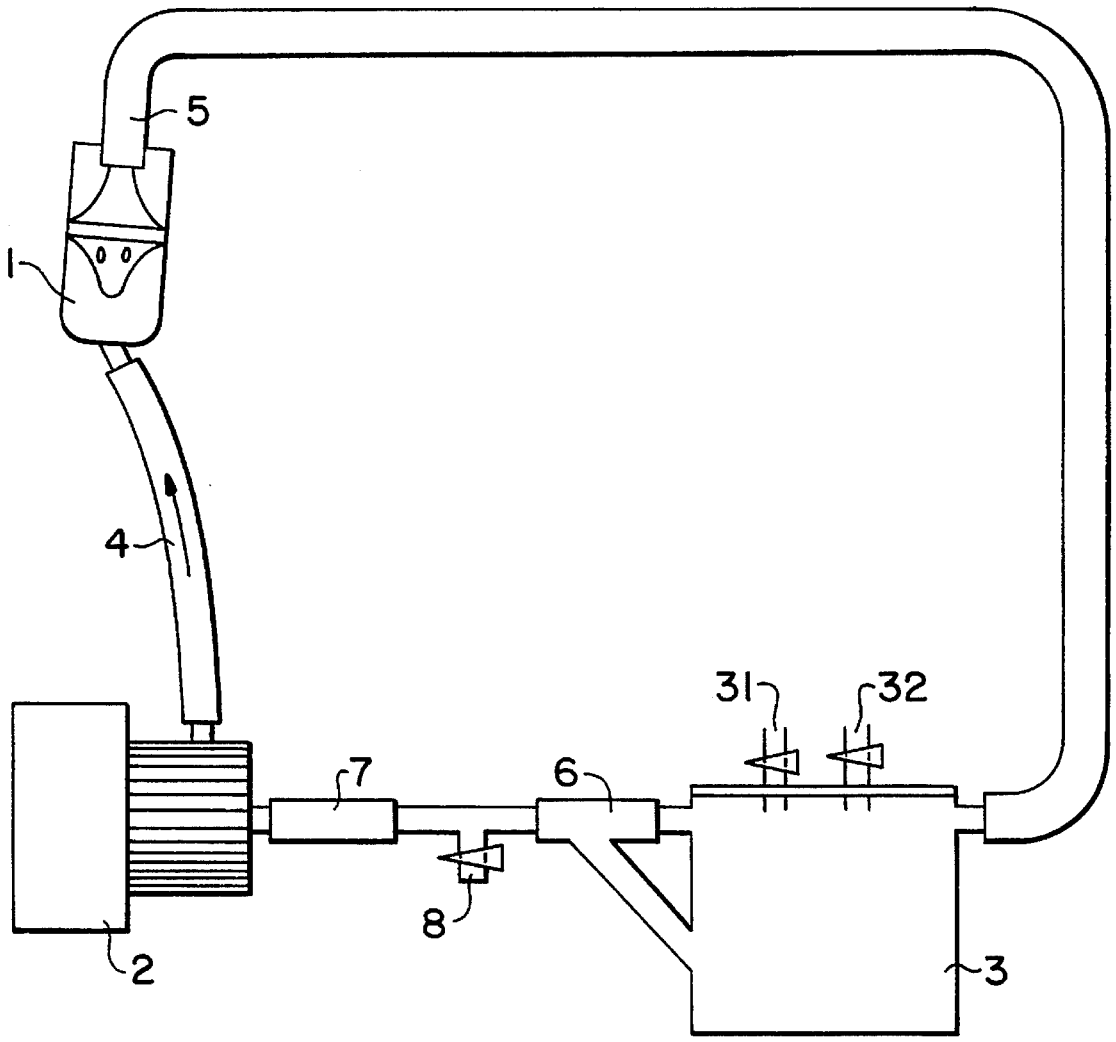
FIG. 1 is a diagram illustrating a general layout of a preferred first embodiment of the mixing device comprising a mixing apparatus used in the present invention.
Figure 2:
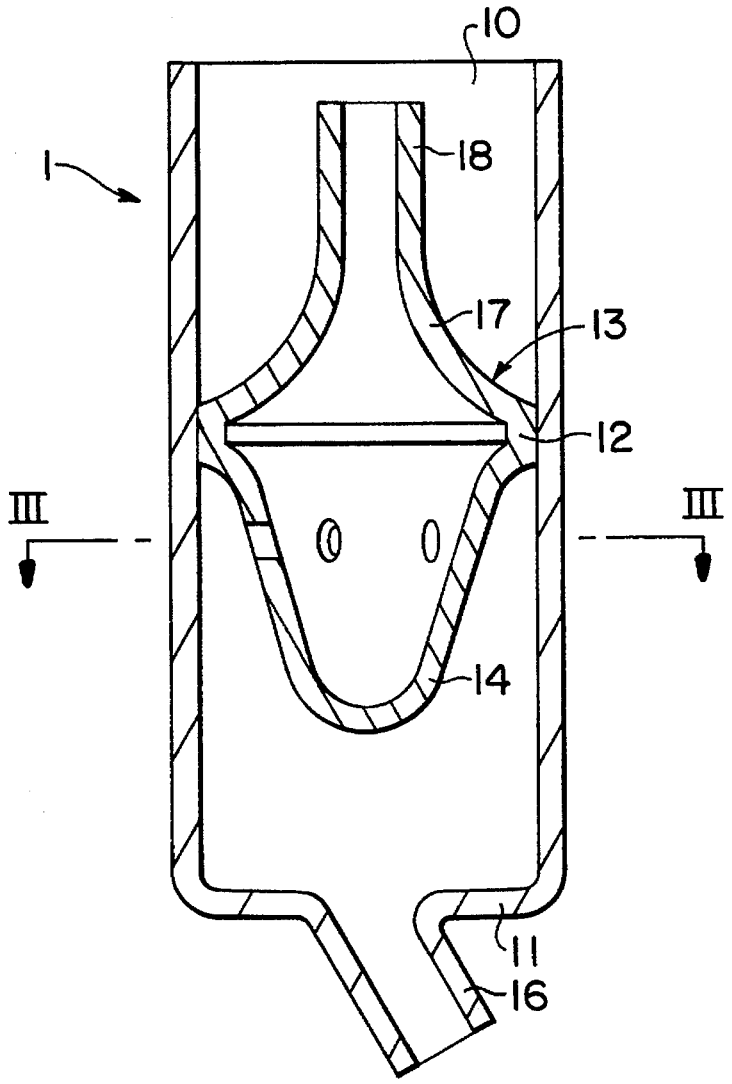
FIG. 2 is an elevation sectional view of the mixing apparatus 1 shown in FIG. 1.
Figure 3:
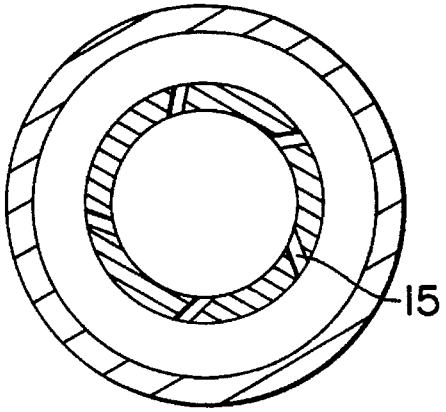
FIG. 3 is a cross sectional view of the top portion of the mixing apparatus 1 shown in FIG. 1.

A general device according to the first embodiment of the device for use in carrying out the present invention is shown in FIG. 1. The elevation of a mixing apparatus 1 is shown in FIG. 2 and the top section of the mixing apparatus 1 in the plane of a hole of the mixing apparatus 1 is shown in FIG. 3. At first, the mixing apparatus 1 is described with reference to FIGS. 2 and 3.

The mixing apparatus 1 comprises a cylindrical wall which is opened at one end 10 and closed at the opposite end 11. Within this cylinder, there is defined a hollow element 13 comprising a first portion 14 having a circular rim 12 connected to the central part thereof and a second portion 17. The first portion 14 of this element 13 has a shape of a substantially hollow parabolic surface arranged in a closed chamber formed between the rim 12 and the closed end 11 of the mixing apparatus 1. In a preferred embodiment, the first portion 14 has a shape of a completely hollow parabolic surface. A certain number of holes 15 are formed through wall of the element 13 at the height (about ⅓ in the embodiment) of the upper position of the first portion 14. In a preferred embodiment, the holes 15 are formed in the tangential direction. Preferably, the sum of the cross-section of the inlet openings (15) substantially corresponds to the cross-section of the duct portion (18) and the difference between these cross-sections is at most 1:3. Furthermore, according to the present invention, a pressure equalizing chamber (11) is provided around the first chamber portion in which fluid mixture is circulated and passed through the tangential inlet openings (15). A duct 16 is extended from the closed end 11 of the mixing apparatus 1 slightly inclinedly with respect to the axis of the mixing apparatus. The element 13 includes the second portion 17 communicating with the first portion 14 at the plane of the rim 12, and this portion has a substantially tapered shape which is continuous as a short cylindrical duct 18. In a preferred embodiment, the portion 17 has a shape of a complete hyperbola. The mixing apparatus 1 is formed of glass. A fluid component is caused to flow to the first portion 14 through the inclined duct 16 while being rotated, and in the first portion 14, the majority of the fluid component introduced into the holes 15 is caused to flow along the inner wall of the first portion 14 toward the top (upward in FIG. 2) while being further rotated. At the top, the flow is reflected and the flow speed is gradually increased, and a vortex state is formed on the central axis toward the second portion. Different substances are mixed by this vortex state.

In use a liquid mixture of a hydrophobic liquid phase and an hydrophilic liquid phase is introduced through the inlet duct 16. Owing to the off-axis and oblique arrangement of the inlet duct 16, the inflowing fluid will rotate around the central axis of the mixing apparatus 1 and the rotating fluid enters in through the tangential openings 15 in the wall 14 of the first chamber portion. In the first chamber portion which has a rotational paraboloid shape of nth grade, a focal line is formed where pressure is at minimum, and along the axis the pressure decreases in axial direction towards the outlet opening. This means that pressure is decreasing gradually both in radial and axial direction, and the fluid rotates around the axis and flows in axial direction.

In the second chamber portion, in the tapering section 17, the speed of flow and the velocity of rotation increases gradually toward the outlet duct portion 18 and in radial direction the pressure decreases towards the axis and a minimum is experienced along the axis. It is preferred if the rotational hyperboloid function has the same grade as the paraboloid function of the first chamber portion has.

The flow will have a structure which can be visualized in such a way as if the fluid mass consisted of an infinitely high number of annular hollow tubes having a form substantially following that of the tapering section 17, and the speed of rotation was different in case of each tube so that the elementary tubes were sliding on each other during their rotational movements. Moreover, the elementary tubes slide with respect to each other not only due to their differing speeds of rotation but they are moving and sliding in axial direction as well.

From this flow picture it will be clear that the imaginary contacting surface of phase boundaries will be extremely large and owing to the imaginary shearing effects between the elementary tubes, very effective contacts will be formed between differing components of the mixture. While the pressure minimum lies in the central axis, the components with lower specific mass will tend to collect at the axis in the vicinity of which the speed is at maximum. This ensures that tiny particles cannot escape from getting in the active zones.

The flow rate should be adjusted in such a way that phase transition (i.e. vaporization of any component) do not take place, nevertheless the minimum pressure should be just above the vapour pressure of the liquid mixture. As several liquid components are present, this condition should relate to the one which has the highest vapor pressure at the given temperature. This condition is equivalent to the statement that cavitation cannot occur in the flow. The mixing apparatus being preferably of glass, said condition can be adjusted by increasing the flow velocity up to a measure at which fine gas bubbles appear in the duct portion 18, and then lowering the flow velocity by a small amount just until the gas bubbles dissappear again.

The first embodiment will now be described with reference to FIG. 1. In the mixing apparatus 1, a closed circulation passage comprising a pump 2 and a vessel 3, which are connected to each other through conduits 4, 5, 6 and 7, is formed. Reference numeral 8 represents a withdrawal opening for the withdrawal of a mixture, which has a cock. The opening is always closed except at the time of the withdrawal of the mixture. The vessel 3 has a cock-provided duct 31 and a cock-provided duct 32 for charging starting materials to be formed into a mixture. The fluid flows as indicated by arrows.

How a stable water/hydrophobic liquid mixture is prepared by introducing a hydrophobic liquid into water without the aid of an emulsifier by using the device shown in FIGS. 1 through 3 will now be described.

At first, the cock of the duct 31 is opened and 9 liters of distilled water is filled in the vessel 3. Then, the cock of the duct 32 is opened and 1 liter of a vitamin A oil as the starting oil is filled in the vessel 3 and the cocks of the ducts 31 and 32 are closed. Incidentally, the vessel 3 is fully filled with water and vitamin A oil, or the upper portion of the vessel 3 may be vacant.

In this arrangement, the pump 2 is started. This pump has a flow quantity of 25 liters/min. The inner diameters of the conduits 4, 5, 6 and 7 are equally about 14 mm. The flow direction is indicated by arrows in FIG. 1. Water and vitamin A oil are introduced into the mixing apparatus 1, and in the mixing apparatus 1, water and vitamin A oil flow into the interior of the cylindrical wall from the inclined duct 16 while being rotated and flow in the first portion 14 through the tangential holes 15 to form a vortex in the hollow element 13. This will now be described in detail. The majority of the rotating fluid component first flows to the closed top of the paraboloid and is reflected forward therefrom, and because of the exponentially tapered shape of the second portion 17 of the hollow element 13, the fluid component is promptly rotated together with the other component and the fluid component is advanced in the conduit 5 toward the vessel 3. Thus, the fluid component is circulated in the closed system until the pump 2 is turned off. After the flow of the mixture of water and vitamin A oil stops, the cock is opened and the water/vitamin A oil mixture is withdrawn from the withdrawal opening 8.

An example in which a hydrophilic liquid is mixed with a hydrophobic liquid by using the mixing device of the embodiment shown in FIG. 1 will now be described. The cock of the duct 31 is opened, and the vessel 3 is filled with 9 liters of ethyl alcohol, and then the cock of the duct 32 is opened and 1 liters of a vitamin oil is filled in the vessel 3. The subsequent procedures are the same as described above. Furthermore, a mixture of 9 liters of a vitamin A oil and 1 liters of ethyl alcohol is similarly prepared according to the above-mentioned method. The obtained mixture formed by mixing ethyl alcohol and vitamin A oil without the aid of an emulsified according to the above-mentioned method can be widely used for cosmetic lotions and cosmetic creams.

An example of the second embodiment of the present invention will now be described in detail with reference to FIG. 4. The same members as in the first embodiment are indicated by the same reference numerals. The second embodiment is different from the first embodiment mainly in that a vessel 9 for forming a second vortex is used instead of the mixing apparatus 3. The vessel 9 has a substantially spherical upper part 91, a lower part 93 tapered downwardly and an intermediate part 92 connected smoothly to the spherical upper part 91 and the lower part 93. The upper part 91 and intermediate part 92 have a convex face and the lower part 93 has a concave face. Thus, an inflection face is formed between the intermediate part 92 and the lower part 93. In a preferred embodiment, the vessel 9 is formed of glass so that the process occurring in the vessel 9 can be observed. Three ducts 95, 96 and 97 are formed on the top wall of the upper part 91 and they are sealed. The vessel 9 is filled with starting substances.

The vessel 9 further has two openings. At a substantial height where the vessel has a maximum diameter, a duct 98 extends obliquely from the upper portion of the intermediate 92. The duct 98 forms an acute angle to each of equator and tangent planes of the vessel 9 and the axis of the duct 98 is slightly inclined inwardly and upwardly in the interior direction of the vessel 9. In general, these angles are smaller than 30°. The second opening is the end of the open bottom of the lower part 93 of the vessel 9. A circulation passage comprising the pump 2, the mixing apparatus 1 and four conduits 4, 5, 6' and 7 is arranged between the lower part 93 and the inclined duct 98.

The second embodiment will now be described with reference to FIG. 4. In the mixing apparatus 1, a closed circulation passage is formed through the pump 2, the vessel 9, withdrawal opening 8 and the conduits 4, 5, 6' and 7.

Figure 4:
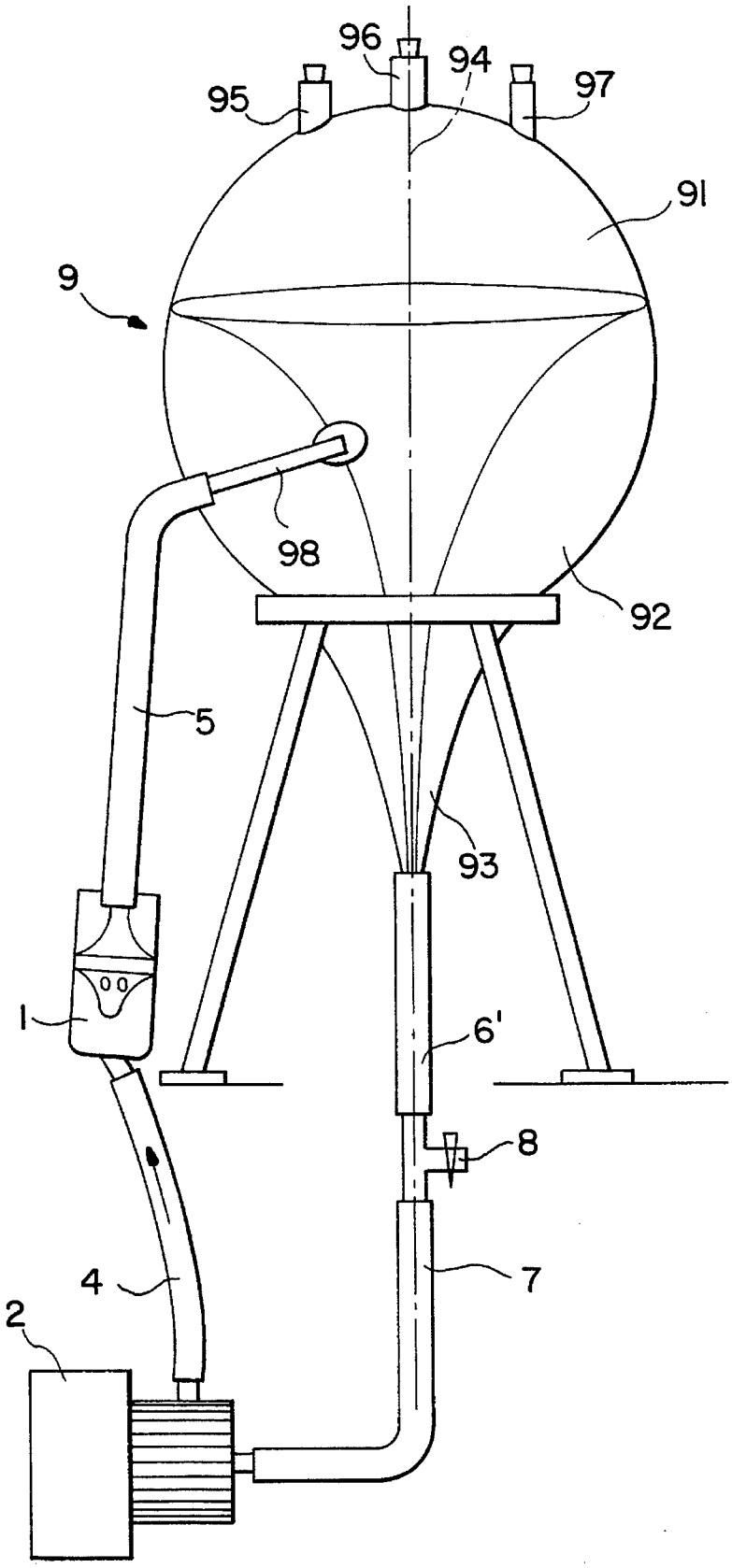
FIG. 4 is a diagram illustrating a second embodiment of the mixing device used in the present invention.

How a water/hydrophobic liquid can be prepared without the aid of an emulsifier by using the device shown in FIG. 4 is described. At first, 9.5 liters of distilled water is filled in the vessel 9 through the duct 97. Then, 0.5 liters of squalane is filled in the vessel 9 through the duct 95. The ducts 95 and 97 are sealed. Incidentally, the vessel 9 may be completely filled with water and squalane, or the upper part of the vessel 9 may be left vacant. In this arrangement, the pump 2 is started. The flow direction is indicated by arrows in FIG. 4. When water and squalane are introduced into the mixing apparatus 1, they flow through the tangential holes 15 to form a first vortex in the hollow element 13, and this first vortex is formed in the same manner as described above. Thus, water and squalane flow into the vessel 9 in the tangential direction throught the inclined inlet duct 98.

Water and squalane which have been quiet in the vessel 9 begin to turn, and a second vortex is formed. A certain time (about 1 to about 2 minutes) is necessary for attaining a stationary state in the vortex. The rotation number of the vortex at the topmost part and maximum diameter part is about 50 r.p.m., and the rotation number increases substantiarly exponentially toward the lower part. Thus, the mixture of water and squalane is circulated in the closed system until the pump 2 is turned off. After the flow of the mixture stops, the cock is opened and the water/squalene mixture is withdrawn from the withdrawal opening 8.

Figure 5:
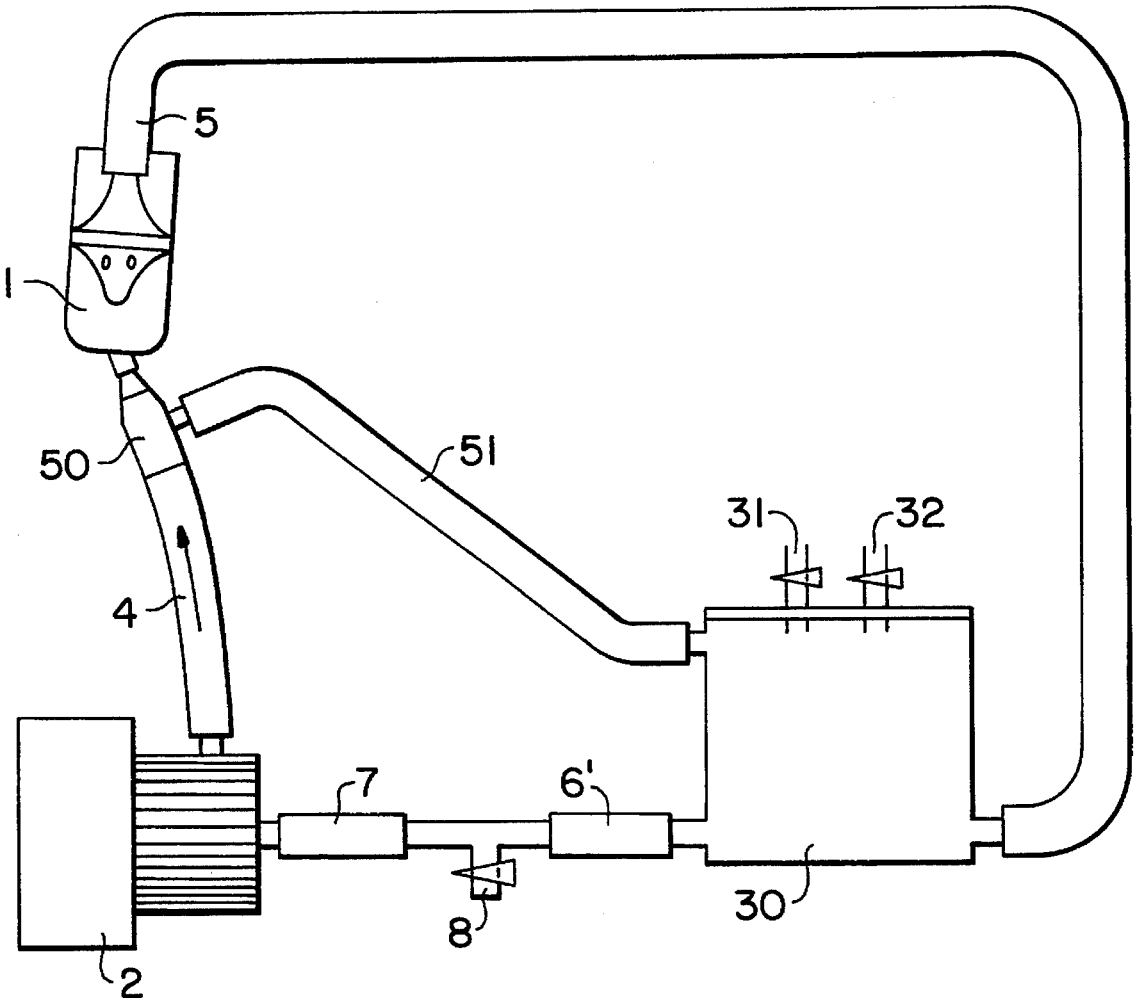
FIG. 5 is a diagram illustrating a third embodiment of the mixing device used in the present invention.
Figure 6:
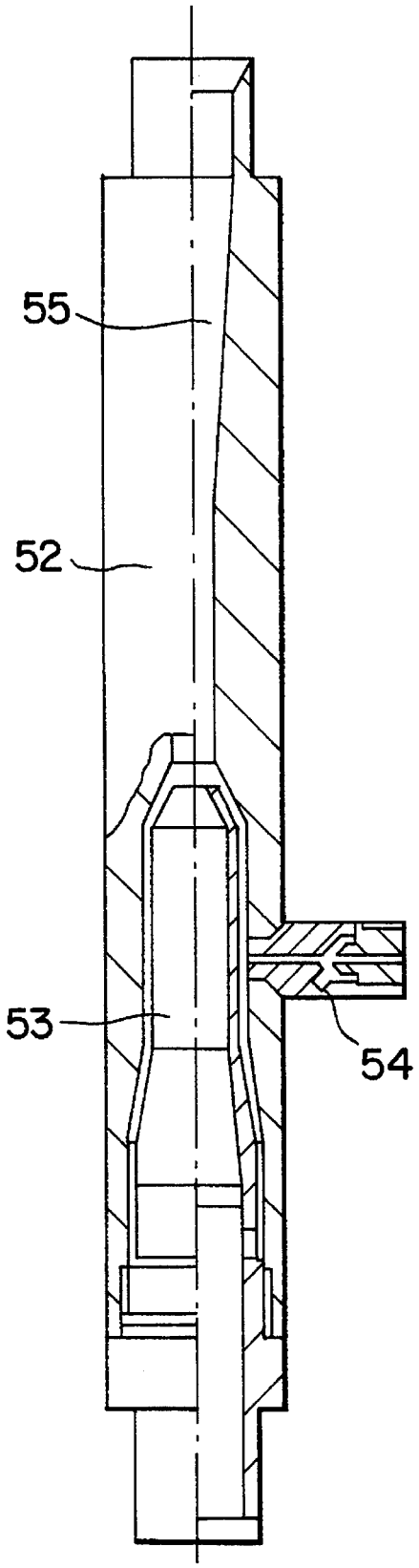
FIG. 6 is a diagram illustrating the structure of an example of the cylindrical housing defining the hollow interior space of the jet pump 50 of the mixing device shown in FIG. 5.

An example of the first embodiment of the present invention will now be described with reference to FIGS. 5 and 6. The same members as in the first embodiment are represented by the same reference numerals. The third embodiment is different from the first embodiment mainly in that a jet pump 50 connected to the mixing apparatus 1 is arranged in the closed system.

In this embodiment, a vessel 30 comprising a cover and ducts 31 and 32 is used. The vessel 30 is filled with starting substances. The vessel 30 is connected to the pump 2 through the conduit 6', withdrawal opening 8 and conduit 7 located at the lower portion of the vessel 30. The flowout conduit 4 is connected to the inlet of the jet pump 50. The internal structure of the jet pump 50 is shown in FIG. 6. An inlet duct 54 of the jet pump 50 communicates with the vessel 30 through a duct 51. The jet pump 50 exerts a function of promoting the mixing of two different liquids. The jet pump 50 has a substantially cylindrical housing 52 having a hollow internal space, as shown in FIG. 6. A nozzle 53 is inserted in the hollow internal space of the housing 52 and the top end of the nozzle 52 is connected to the duct 4. A cylindrical space is formed in the vicinity of the top end of the nozzle 53 and an inlet duct 54 is inserted in the wall of the housing 52, and as the result, the hollow internal space of the inlet duct 54 communicates with the cylindrical space in the vicinity of the top end of the nozzle 53. In this example, the water jet pump is used, but there may be adopted a method in which a branched pipe is used instead of the water jet pump and the outlet side of this tube is connected to the inlet side of the mixing apparatus 1.

It will now be described how a stable hydrophilic liquid/hydrophobic mixture is prepared by introducing a hydrophobic liquid into a hydrophilic liquid without the aid of emulsifier by using the device shown in FIGS. 5 and 6.

At first, the cock of the duct 31 is opened and the vessel 31 is filled with 9.5 liters of ethyl alcohol. Then, the cock of the duct 32 is opened and 0.5 liters of squalane as the starting oil is filled in the vessel 30. The cock of the ducts 31 and 32 are closed. When the pump 2 is started, a squalane-rich liquid in the vessel 30 is sucked into the pump 2 and is caused to flow in the vessel 30 through the conduit 4, jet pump 50, mixing apparatus 1 and conduit 5. Thus, a closed system is formed. Furthermore, an alcohol-rich liquid in the vessel 30 is injected into the jet pump 50 through the conduit 51. In this closed system, ethyl alcohol and squalane are mixed by the circulation. In this manner, a mixture of ethyl alcohol and squalane is formed.

As is apparent from the foregoing description, if the mixing apparatus 1 is used, a plurality of substances can be mixed irrespective of the composition thereof.

Furthermore, if this mixing apparatus 1 is used, at least two kinds of liquids can be stably and homogeneously mixed.

Figure 7:
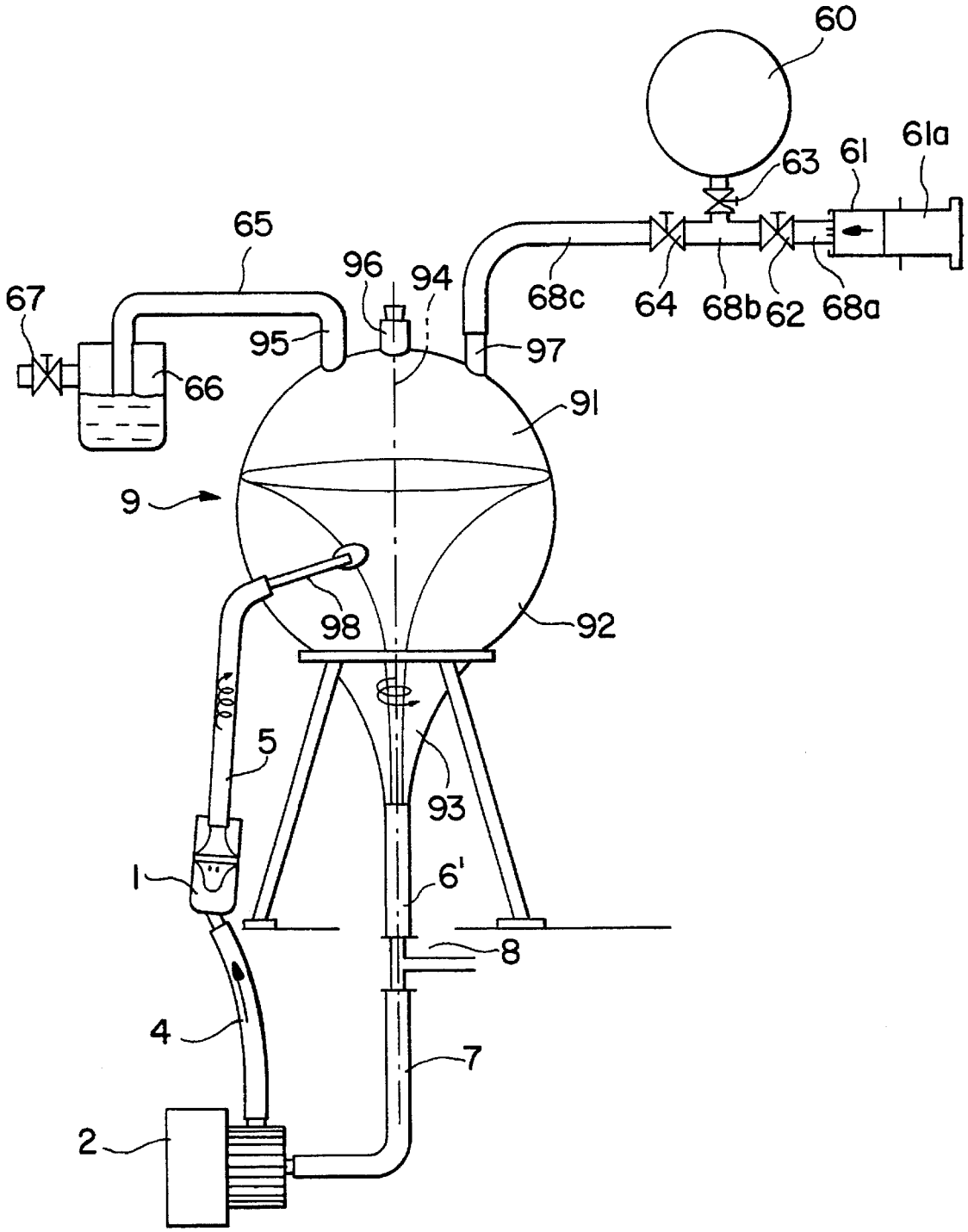
FIG. 7 is a diagram illustrating a mixing device resembling the mixing apparatus shown in FIG. 4.

FIG. 7 shows a device resembling the device shown in FIG. 4. The pump 2 and mixing apparatus 1 are those used in the first embodiment, and the vessel 9 is that used in the second embodiment. An oxygen-supplying gas source 60 and an injector (with no needle) 61 are used. The gas source 60, injector 61 and duct 97 are connected to conduits 68 (68*a*, 68*b* and 68*c*) provided with glass cocks 62, 63 and 64, respectively. The duct 95 is connected to a conduit 65, the end of the conduit 65 is contained in a trap 66 filled with water, and the trap 66 is connected to a glass cock 67.

At first, a duct 96 is opened and 10 l of octane as the hydrophobic liquid is filled in the vessel 9, and the duct 96 is closed.

The glass cock 62 and 64 are opened and a pressing member (piston) 61*a* of the injector 61 is taken out from the injector 61. For a while, the glass cock 63 is opened to inject oxygen into the circulation passage for expelling air present in the interior. The pressing member is set at the injector 6 so that the measurement scale is 200 ml. After the glass cock 63 is closed, the level of water in the trap 66 is made in agreement with the water level in the conduit 65, and the glass cock 67 is closed. When the pump 2 is started, the pressure in the vessel 9 is reduced, and a reduced pressure is also maintained in the conduit 65 and the water level in the conduit becomes higher than the water level in the trap 66. The pump 2 is stopped twice a day, and oxygen in the injector 61 is pressed into the circulation passage through the pressing member 61*a* so that the water level in the trap 66 is made equal to the water level in the conduit 65. When oxygen in the injector 61 is exhausted, in the same manner as described above, the glass cock 63 is opened and the gas source 60 is connected to the injector and oxygen is injected into the injector 61. A series of experiments were carried out in the above-mentioned manner.

The intake of oxygen gas for 28 days' operation was 7440 ml/10 liters (21° C.). This value corresponds to about 2.4 times the saturation solubility.

After the termination of the experiment, the pump 2 was stopped and the system was allowed to stand still. After 12 hours' stoppage of the pump, the water level in the trap 66 was measured, but no change was observed. Accordingly, it can be said that octane containing an excessive amount of oxygen was stable.

Then, the experiment was similarly carried out, by using 100 ml of methyl alcohol as the hydrophilic liquid instead of octane.

The intake of oxygen gas for 28 hours' operation was 6640 ml/10 liters (21° C.). This value corresponds to about 2.8 times the saturation solubility.

After the termination of the experiment, the pump 2 was stopped and the system was allowed to stand still. After 12 hours' stoppage of the pump 2, the water level of the trap 66 was measured. No change was observed. Accordingly, it can be said that methyl alcohol containing the excessive amount of oxygen was very small. In the present example, the vessel 9 for forming the second vortex was used, but any device capable of supplying a liquid and a gas into the mixing apparatus 1 can be used.

Figure 8:
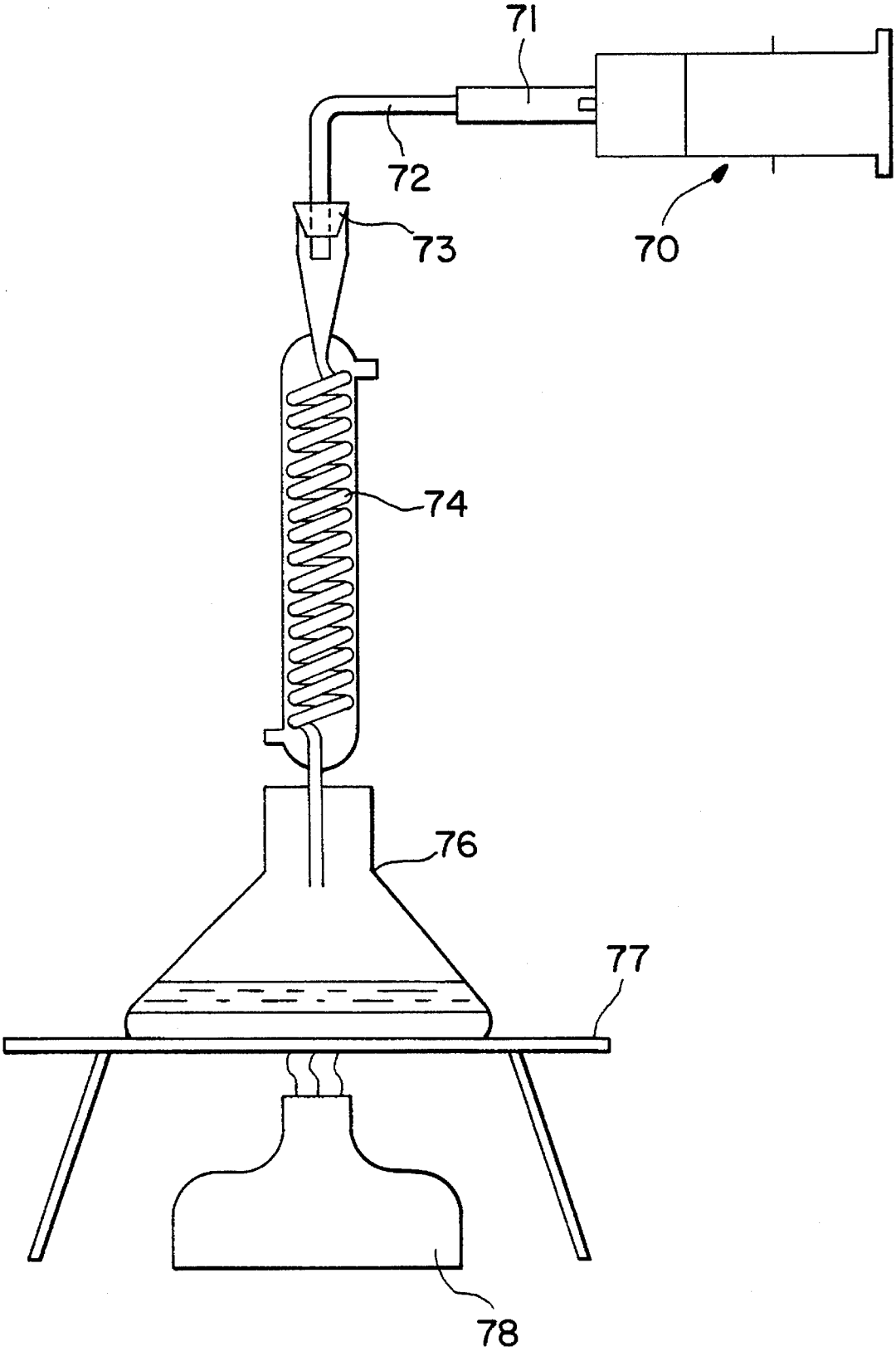
FIG. 8 is a diagram illustrating an example of the apparatus used for measuring the stability of a mixture containing a saturation amount of a gas in a hydrophobic liquid or hydrophilic liquid.

An embodiment of the apparatus for measuring the stability of a gas-containing mixture of a hydrophobic liquid or hydrophilic liquid is illustrated in FIG. 8.

An Erlenmeyer flask 76 is charge with 100 ml of octane containing an excessive amount of oxygen gas, and the upper space is filled with air. The Erlenmeyer flask 76 is arranged on a stand 77 and can be heated from below by a burner 78. The top end portion of the Erlenmeyer flask 78 is connected to a hose type cooling tube 74 by using a fitting glass. This hose type cooling tube 74 is perpetually cooled by cooling water not shown in the drawings. The top end of the hose type cooling tube 74 is sealed by a plug and is connected to an injector 70 through a glass tube 72 and a silicone tube 71. At first, a piston is set at a scale of "O". When the concentration of oxygen in the open air is measured by a gas detector for the measurement of the oxygen concentration (supplied by Gastec co.), it is found that the concentration is 20.8%. Then, octane containing an excessive amount of oxygen gas is charged in the Erlenmeyer flask 78 and is boiled by the burner 78. By this boiling, the pressing member of the injector 70 is pressed back. The injector 70 is taken out, and the oxygen gas concentration in air in the injector 70 is measured. The oxygen concentration is 22.1%. The same sample is boiled for 2 hours and the measurement is conducted in the same manner as described above. The oxygen concentration is 22.1%. Accordingly, it can be said that oxygen contained in octane is stable in a super-saturated state (about 2.3 times). The stability measurement test is similarly carried out with respect to methyl alcohol containing an excessive amount of oxygen gas by using the same measurement equipment as mentioned above. The oxygen concentration in the open air is 20.8% and the oxygen concentration after 1 hour's boiling is 21.9%. Furthermore, the oxygen concentration after 2 hours' boiling is 21.9%. Accordingly, it can be said that oxygen contained in methyl alcohol in a super-saturated state (about 2.7 times) is in a stable state.

When the same experiment is carried out with respect to methyl alcohol by using carbon dioxide instead of oxygen, the volume of carbon dioxide contained in methyl alcohol is about 1.8 times the saturation solubility, and at the stability test, a stable state is observed at a concentration about 1.35 times the saturation solubility. Accordingly, it is understood that if the mixing apparatus of the present example is used, a gas is stably incorporated in other gas in a super-saturation state.

The physical states of water/hydrophobic liquid mixtures and hydrophilic liquid/hydrophobic liquid mixtures obtained according to the above-mentioned first through third embodiments were tested. One drop of the water/vitamin A oil obtained according to the first embodiment was collected from each of the upper and lower portions of the vessel 30 by a syringe and dropped on a preparation. The water/vitamin A oil mixture on the preparation was photographed (600 magnifications) at a photographic sensitivity of ASA1000 by Nicon F.2 supplied by Nippon Kogakusha, which was attached to an optical microscope (M-862 supplied by Carton Co.), and it was confirmed that the vitamin A oil was homogeneously distributed in the form of droplets having a size of about 500 nm. In order to confirm the stability of the water/vitamin A oil mixture, the mixture was stored in the sealed state in a thermostat tank maintained at 50° C. for 13 days, and the mixture was observed by a microscope photo in the same manner as described above. The state was not substantially different from the state just after the mixing. Thereafter, about 4 ml of the mixture of water and vitamin A was placed in a cubic cell and, after setting a slit (width=0.1 mm), to a laser beam from a laser beam source unit (i.e., GL-803N, manufactured by Nakamura Rika Ko o K.K.), the cubic cell was irradiated with a laser beam. As a result, a Tyndall phenomenon was confirmed. Then, the cubic cell was set on a microscope (BH-2 manufactured by Olympus optical co., Ltd.) and an ultramicroscope was composed, together with the above-mentioned laser beam source unit. Thus, the cubic cell was irradiated with a laser beam via the above-mentioned slit from the laser beam source unit. As a result, the existence of oil drops was confirmed and the occurrence of a Brownian movement was also confirmed. As a comparative sample, a mixture of 10 ml of vitamin A oil and 90 ml of water was placed in a vessel and was stirred for a long time in a ultrasonic cleaner (i.e., "SONO CLEANER" CA=2480 manufactured by Kaijyo Denki K.K.). The resultant mixture was allowed to stand at room temperature for one day under a tightly sealed condition. As a result, it was confirmed that the water and the vitamin A oil in the vessel were separated and the underpositioned water was transparent and was not turbid. On the other hand, when one drop each of the upperpositioned vitamin A oil and the underpositioned water placed on a separate preparation was observed by the above-mentioned optical microscope, it was confirmed that neither the water drops nor the oil drops were a mixture of water and oil. Furthermore, neither oil in the water drops nor water in the oil drops were observed by the above-mentioned ultramicroscope.

It also was confirmed that as the circulation time in the embodiment of FIG. 1 was long, the droplet size became finer. The water/vitamin A oil mixture on the preparation was warmed to evaporate water, and adhesion of the oily substance onto the preparation was confirmed. When the water/squalane mixture was similarly tested, the same results as described above were obtained.

Similarly, the physical conditions of mixtures of water and gas oil obtained from 1 liter of water and 9 liters of gas oil (i.e., hydrophobic oil) in the above-mentioned first, second and third embodimants of the present invention were examined. As a result, it was confirmed by the optical microscope that the water drops having approximately the same size of about 500 nm were uniformly distributed in the oil liquid. Furthermore, similarly as mentioned above, the occurrence of the Tyndall phenomenon, the existence of the water drops by the ultramicroscope, and the occurrence of the Brownian movement of the water drops were confirmed.

Furthermore, when the mixtures were allowed to stand for a long time, it was observed that the upper oil-in-water portion and the lower water-in-oil portion are stably existed as a colloidal condition. In addition, when the resultant mixtures were centrifugally separated for 5 minutes at 3,000 rpm, it was confirmed by the above-mentioned optical microscope that the occurrence of the Tyndall phenomenon was confirmed in the resultant centrifugally separated portion although the present of the water drops was not observed. Furthermore, when the centrifugally separated portion was observed by a ultramicroscope, the existence of the water drops and the occurrence of the Brownian movement were confirmed. Accordingly, the size of the water drops was estimated to be about 100 nm.

Moreover, when the mixtures was prepared by the above-mentioned ultrasonic cleaner, the resultant mixtures were separated after allowing to stand at room temperature for one hour, into water and gas oil and the lower water phase was transparent.

When the ethyl alcohol/vitamin A oil mixture prepared according to the first embodiment as the hydrophilic liquid/hydrophobic mixture was photographed by the microscope according to the above-mentioned method, it was confined that the droplet size of the vitamin A oil in ethyl alcohol was about 500 nm. No substantial change of the state was observed with respect to the distribution of ethyl alcohol and vitamin A oil between the mixture just after the mixing and the mixture which had been stored in a thermostat tank maintained at 50° C. for 20 days. When the ethyl alcohol/vitamin A oil mixture on the preparation was warmed to evaporate water, adhesion of the oily substance onto the preparation was confirmed.

When the ethyl alcohol/squalane mixture was similarly tested, the same results as described above were obtained.

In the present embodiment, illustration has also been made with respect to the combination of one liquid and one gas. However, the present embodiment is not limited to this combination and a combination of a plurality of liquids and one gas or a combination of a plurality of liquids and a plurality of gases can be used.

A plurality of mixing apparatuses 1 can be arranged in series or in parallel in one closed flow passage, and other substances can be supplied linearly or in the reversely rotated state in a vortex formed within the mixing apparatus. Furthermore, the mixing method, mixing device and mixture are not limited to those specifically disclosed in the examples.

As is apparent from the foregoing illustration, by using the mixing device and mixing method of the present invention, a plurality of substances different in their physical properties can be mixed. By the term "hydrophobic liquid" is meant oily materials such as carnauba wax and liquid paraffin and fossil fuels such as benzene, decane, and gas oil, vegetable oils such as sesame oil, and by the term "hydrophilic liquid" is meant various alcohols such as monohydric and dihydric alcohols.

The obtained mixture is advantageous in the cost because an emulsifier need not be used, and hence, the limitations by the use of the emulsifier or the like are eliminated and the mixture can be widely used. Moreover, if a hydrophilic liquid containing oxygen is used for cosmetic lotions or cosmetic creams, an effect of activating the skin can be attained. Furthermore, hydrophobic liquids (e.g., vegetable oil) and hydrophilic liquids (e.g., ethyl alcohol, propylene glycol) containing oxygen may be used as a solvent for pharmaceutical applications such as the production of injections.

What is claimed:

1. A device for producing a liquid emulsion of at least one hydrophobic liquid phase and at least one hydrophilic liquid phase comprising a recirculation conduit path and a mixing apparatus provided in the recirculation conduit path, said mixing apparatus (1) having a longitudinal axis and comprising a hollow element (13) having a first and a second chamber portion, said first chamber portion having a plurality of tangential inlet openings (15) and having a rotational paraboloid form with a shape that tapers in a first direction, said first chamber portion (14) communicating with said second portion (17) having a shape which tapers in a second direction opposite to said first direction, said second portion (17) having an axial outlet being coaxial with said longitudinal axis of the mixing apparatus, said axial outlet of said second chamber portion (17) defining a cylindrical outlet duct portion (18), said first chamber portion (14) defining a focal line coaxial with said longitudinal axis of said mixing apparatus, the sum of the cross-sections of the inlet openings (15) substantially corresponding to the cross-section of said duct portion (18) and the differences between these cross-sections being at most 1:3, a pressure equalizing chamber (11) having a bottom wall portion and an axis coaxial with said longitudinal axis of said mixing apparatus and having an aperture in said bottom wall portion located on said axis, said pressure equalizing chamber being provided around said first chamber portion (14) in which a fluid mixture of a hydrophobic liquid and a hydrophilic liquid may be circulated and passed through said tangential inlet openings (15), said pressure equalizing chamber having an inlet duct (16) for said fluid mixture communicating with said aperture and defining an acute angle with said axis of said pressure equalizing chamber (11) at said bottom wall.

2. The device as claimed in claim 1, comprising a pump means in said recirculation path for passing said fluid through said mixing apparatus and for recirculating it through said recirculation path with a flow rate at which the minimum pressure provided at said longitudinal axis is still higher than the highest vapor pressure of the liquid components to be mixed.

3. The device as claimed in claim 2, wherein said pressure equalizing chamber (11) has a cylindrical shape and is coaxial with said longitudinal axis and wherein said bottom wall portion is upstream of said first chamber portion (14).

* * * * *